US007290867B2

(12) United States Patent
Kobayashi et al.

(10) Patent No.: US 7,290,867 B2
(45) Date of Patent: Nov. 6, 2007

(54) LIQUID DELIVERING APPARATUS

(75) Inventors: Kazuo Kobayashi, Kakamigahara (JP); Chikamasa Hattori, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 168 days.

(21) Appl. No.: 10/876,531

(22) Filed: Jun. 28, 2004

(65) Prior Publication Data

US 2005/0030350 A1 Feb. 10, 2005

(30) Foreign Application Priority Data

Aug. 4, 2003 (JP) ..... 2003-286084

(51) Int. Cl.
*B41J 2/045* (2006.01)

(52) U.S. Cl. ..... 347/71

(58) Field of Classification Search ..... 347/68, 347/70–72; 29/25.35

See application file for complete search history.

(56) References Cited

U.S. PATENT DOCUMENTS

| | | | | |
|---|---|---|---|---|
| 4,502,059 | A * | 2/1985 | Blessington | 347/68 |
| 4,516,140 | A | 5/1985 | Durkee et al. | |
| 4,584,590 | A | 4/1986 | Fischbeck et al. | |
| 5,402,159 | A * | 3/1995 | Takahashi et al. | 347/9 |
| 5,512,793 | A * | 4/1996 | Takeuchi et al. | 310/328 |
| 5,691,752 | A | 11/1997 | Moynihan et al. | |
| 5,761,783 | A * | 6/1998 | Osawa et al. | 29/25.35 |
| 6,270,203 | B1 | 8/2001 | Kitahara et al. | |
| 6,273,558 | B1 * | 8/2001 | Kitahara | 347/72 |
| 6,290,340 | B1 | 9/2001 | Kitahara et al. | |
| 6,371,602 | B1 | 4/2002 | Asano | |
| 6,532,028 | B1 | 3/2003 | Gailus et al. | |
| 6,536,880 | B2 * | 3/2003 | Takagi | 347/72 |
| 6,575,544 | B2 * | 6/2003 | Iriguchi | 347/11 |
| 6,595,628 | B2 | 7/2003 | Takagi et al. | |
| 6,601,949 | B1 | 8/2003 | Kitahara | |
| 2003/0030705 | A1 | 2/2003 | Koike et al. | |
| 2003/0063449 | A1 | 4/2003 | Suzuki et al. | |
| 2003/0112299 | A1 | 6/2003 | Kitahara | |
| 2005/0270339 | A1 * | 12/2005 | Sugahara | 347/68 |

FOREIGN PATENT DOCUMENTS

| | | |
|---|---|---|
| JP | A-06-079871 | 3/1994 |
| JP | A-06-234218 | 8/1994 |
| JP | B2-3171213 | 3/2001 |
| JP | A 2002-240278 | 8/2002 |

* cited by examiner

*Primary Examiner*—An H. Do
(74) *Attorney, Agent, or Firm*—Oliff & Berridge, PLC

(57) ABSTRACT

A liquid delivering apparatus including: at least one piezoelectric element; a plurality of electrodes which generate an electric field for deforming the at least one piezoelectric element; a drive circuit which supplies a drive voltage to the plurality of electrodes; a plurality of liquid chambers which store liquid, the liquid being given pressure by deformation of the at least one piezoelectric element, so that the liquid is delivered from the plurality of liquid chambers to an exterior of the apparatus; and an insulating sheet and a plurality of wires which connect the plurality of electrodes to the drive circuit, the plurality of electrodes and the plurality of wires being formed on the insulating sheet.

22 Claims, 6 Drawing Sheets

LIQUID DELIVERING APPARATUS

The present application is based on Japanese Patent Application No. 2003-286084 filed Aug. 4, 2003, the contents of which are incorporated herein by reference.

BACKGROUND OF THE INVENTION

1. Field of the Invention

The present invention relates in general to a liquid delivering apparatus. In particular, the present invention relates to, in such an apparatus which delivers liquid by giving pressure thereto owing to deformation of a piezoelectric element, an electric connection structure between an electrode for generating an electric field in the piezoelectric element and a drive circuit.

2. Discussion of Related Art

There is known a liquid delivering apparatus which delivers liquid accommodated in a liquid chamber to an exterior of the apparatus, by giving pressure to the liquid owing to deformation of a piezoelectric element. In such an apparatus, a drive voltage is supplied to an electrode for producing an electric filed in the piezoelectric element, so that the piezoelectric element is deformed to thereby give the pressure to the liquid in the liquid chamber. As one example of such a liquid delivering apparatus, JP-A-2002-240278 or its corresponding U.S. Pat. No. 6,595,628 discloses a piezoelectric-type ink jet recording head to be installed on an ink jet printer. The ink jet recording head disclosed in the Publication includes a cavity unit including a plurality of ink ejection nozzles from which ink is ejected and a plurality of pressure chambers corresponding to the respective nozzles, a piezoelectric actuator in which a plurality of internal electrodes provided for the respective pressure chambers and a plurality of piezoelectric sheets are arranged such that each internal electrode is interposed between adjacent two piezoelectric sheets, and a flexible flat cable on which a plurality of wires for supplying a drive voltage from a drive circuit to the internal electrodes are printed, the cavity unit, the piezoelectric actuator and the flexible flat cable being superposed on each other in this order.

On the uppermost surface of the piezoelectric actuator which is opposed to the flexible flat cable, there are formed surface electrodes which are connected to the wires of the flexible flat cable. The surface electrodes are connected, via an electrically conductive material filled in through-holes that are formed through the plurality of piezoelectric sheets in the direction of stacking thereof, to the respective internal electrodes which are aligned with the surface electrodes in the direction of stacking. The flexible flat cable is superposed or laminated on the uppermost surface of the piezoelectric actuator such that the surface electrodes are connected to the wires of the flexible flat cable, so that the drive circuit and the internal electrodes are electrically connected via the wires of the flexible flat cable. In the thus constructed ink jet recording head, when the drive voltage is applied from the drive circuit to the internal electrodes via the wires, the piezoelectric sheets interposed between the internal electrodes are deformed, whereby the ink in the pressure chambers are given the pressure, so that the ink is ejected from the nozzles.

SUMMARY OF THE INVENTION

To meet recent demands for an increase in the resolution of printed images and a reduction in the size of the ink jet recording head, it is a general tendency that the size (diameter) of the nozzles is reduced and the nozzles are formed with higher density. Further, the pressure chambers, the internal electrodes, and the surface electrodes which are provided so as to align with the respective nozzles are also formed with higher density. Accordingly, it is rather difficult to connect, as conventionally conducted, the surface electrodes formed on the uppermost surface of the piezoelectric actuator and the wires formed on the flexible flat cable. Therefore, the ink jet recording head may suffer from malfunction due to poor connection between the surface electrodes and the wires.

It is therefore an object of the present invention to provide a liquid delivering apparatus which assures reliable electrical connection between electrodes and a drive circuit even where the electrodes are formed with high density, and which can be operated with high reliability.

The object indicated above may be achieved according to a principle of the present invention, which provides a liquid delivering apparatus including: at least one piezoelectric element; a plurality of electrodes which generate an electric field for deforming the at least one piezoelectric element; a drive circuit which supplies a drive voltage to the plurality of electrodes; a plurality of liquid chambers which store liquid, the liquid being given pressure by deformation of the at least one piezoelectric element, so that the liquid is delivered from the plurality of liquid chambers to an exterior of the apparatus; and an insulating sheet and a plurality of wires which respectively connect the plurality of electrodes to the drive circuit. The plurality of electrodes and the plurality of wires are formed on the insulating sheet.

In the liquid delivering apparatus constructed as described above, the drive voltage is supplied from the drive circuit to the plurality of electrodes formed on the insulating sheet, via the plurality of wires also formed on that insulating sheet. When the drive voltage is supplied from the drive circuit to the electrodes via the wires, the electrodes produce an electric field in the at least one piezoelectric element and the piezoelectric element is deformed owing to the electric field, so that pressure is given to the liquid in the liquid chambers. Thus, the liquid in the liquid chambers is delivered to the exterior of the apparatus. In the thus constructed apparatus wherein the electrodes which generate the electric field for deforming the piezoelectric element and the wires which connect the electrodes to the drive circuit are formed on the single, common insulating sheet, it is not necessary to carry out a conventionally required step of superposing separate two sheets on which electrodes and wires are respectively formed, such that the electrodes and the wires are connected to each other. Accordingly, even where the plurality of electrodes are arranged with high density, drive signals can be supplied to the electrodes with high reliability, resulting in a considerably high operation reliability of the apparatus.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIGS. 5A and 5B are enlarged, cross sectional views schematically showing the piezoelectric-type ink jet recording head of FIG. 2, taken along line 5-5 of FIG. 2, wherein FIG. 5A shows a state in which the voltage is not applied to the internal electrode while FIG. 5B shows a state in which the voltage is applied to the internal electrode.

DETAILED DESCRIPTION OF THE PREFERRED EMBODIMENTS

Hereinafter, there will be described preferred embodiments of the present invention by reference to the drawings.

Figure 1:
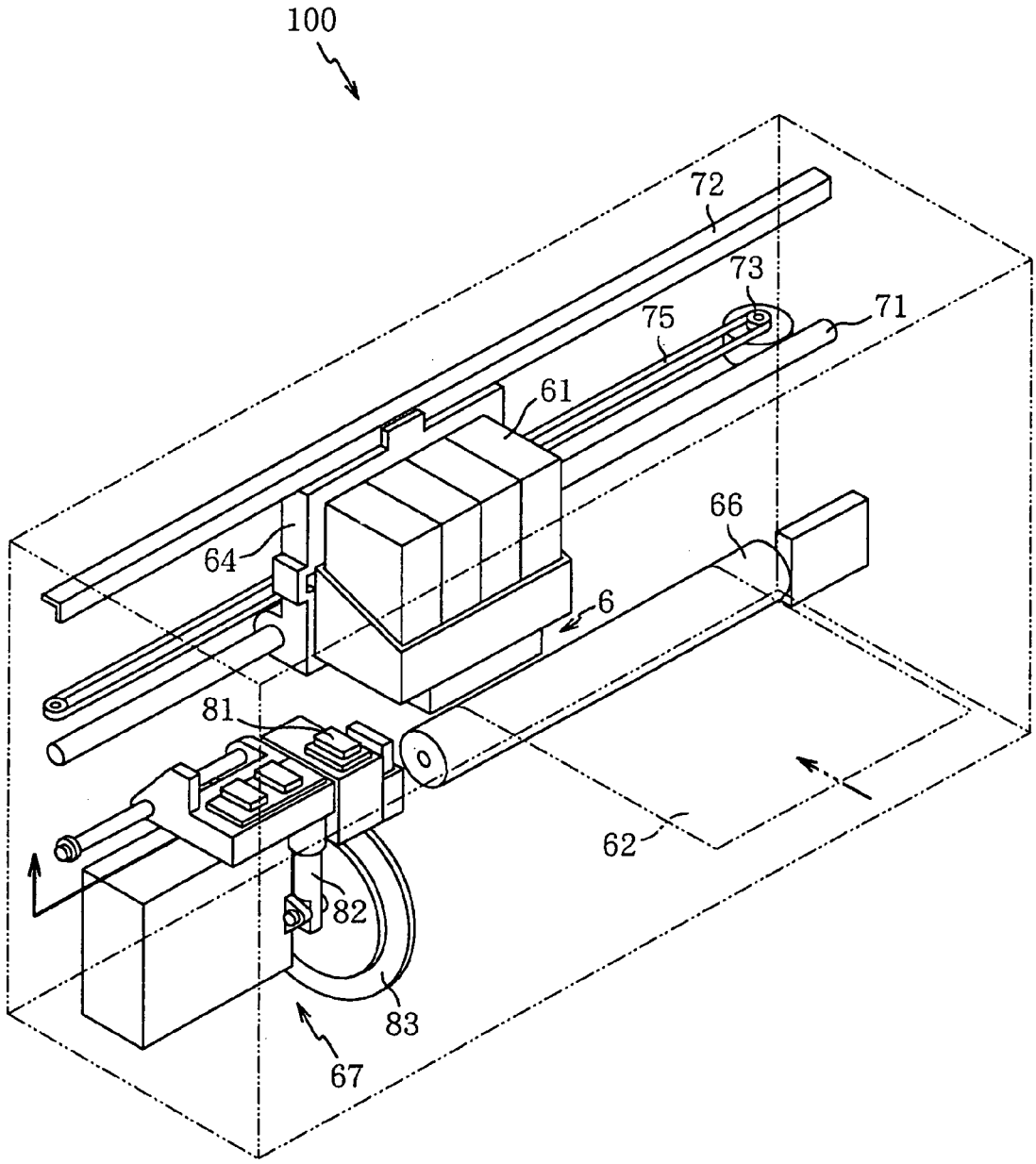
FIG. 1 is a perspective view of an ink jet recording apparatus including a piezoelectric-type ink jet recording head to which the present invention is applied.
Figure 2:
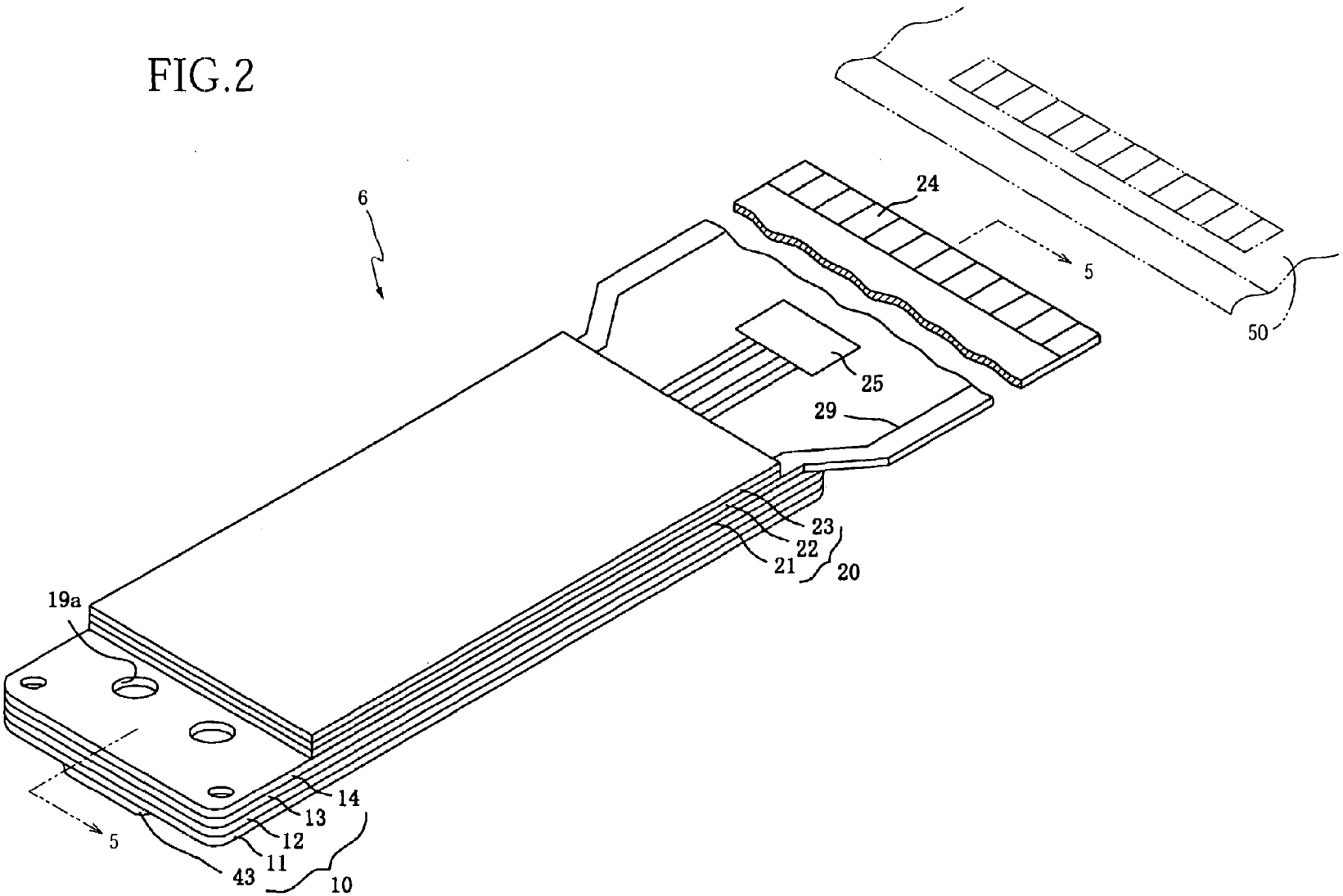
FIG. 2 is a perspective view of the ink jet recording head.

FIG. 1 shows an ink jet recording apparatus 100 including a piezoelectric-type ink jet recording head 6 to which the present invention is applied and which is constructed according to a first embodiment of the invention. The ink jet recording apparatus 100 will be briefly described. The piezoelectric ink jet recording head 6 is arranged to eject ink from ink ejection nozzles 54 (FIG. 4) toward a recording medium such as a sheet of paper 62. The ink jet recording head 6 is disposed on a lower surface of a carriage 64 on which ink cartridges 61 are mounted. The structure of the ink jet recording head 6 will be described in detail.

The carriage 64 on which the ink jet recording head 6 is mounted is fixed to an endless belt 75, and is reciprocated along a guide bar 71 and a guide plate 72 when a pulley 73 is rotated forward and backward by an electric motor. During the reciprocation of the carriage 64, droplets of ink are ejected from the ink ejection nozzles 54 of the piezoelectric ink jet recording head 6 toward the sheet of paper 62. The paper 62 is fed from a sheet supply cassette (not shown) provided in the ink jet recording apparatus 100, to a location between the ink jet recording head 6 and a platen roller 66. After the ink jet recording head 6 records images on the paper 62, the paper 62 is discharged. A sheet feeding device and a sheet discharging device for feeding and discharging the sheet of paper 62, respectively, are not shown.

A purging device 67 is provided on one side of the platen roller 66. The purging device 67 is for removing undesirable poor-quality ink remaining in the ink jet recording head 6. Described in detail, when the carriage 64 is positioned at a resetting position, a purging cap 81 of the purging device 67 covers the surface of the recording head 6 in which the nozzles are formed, so as to form an air-tight space. Then, the air-tight space is depressurized by an air pump 82 which communicates with the purging cap 81 and which is operated by a cam 83. Thus, the undesirable poor-quality ink remaining the ink jet recording head 6 is removed.

The ink jet recording apparatus 100 includes therein control circuits (not shown) which include CPU, ROM, RAM, etc., and which control the apparatus 100 according to control programs relating to operations of the apparatus 100. The ink ejection operation and the purging operation which is conducted by the purging device 67 are controlled by the control circuits.

Referring next to FIG. 2 through FIG. 5A, there will be described a structure of the piezoelectric ink jet recording head 6. As shown in the perspective views of FIGS. 2 and 3, the piezoelectric ink jet recording head 6 includes a cavity unit 10 having a plurality of liquid chambers 16 each opening upward and a piezoelectric actuator 20 which is fixed with an adhesive to an upper surface of the cavity unit 10 in which the liquid chambers 16 open upward, so that the piezoelectric actuator 20 closes the respective upper openings of the liquid chambers 16.

The cavity unit 10 has a stacked structure including a plurality of plate members which are stacked on each other. Described more specifically by referring to FIG. 4, the cavity unit 10 of the present embodiment has the stacked structure consisting of five plate members, i.e., a nozzle plate 43, two manifold plates 11, 12, a spacer plate 13, and a cavity plate 14. Each of those plates 11, 12, 13, 14, 43 has a thickness of about 50 μm to about 150 μm. In the present embodiment, the four plates 11, 12, 13, 14 except for the nozzle plate 43 are formed of metal plate members obtained by rolling of metal such as stainless, titanium, a titanium alloy, copper, a copper alloy, tool steel, low alloy steel, nickel, a nickel alloy, a cobalt alloy, aluminums, or an aluminum alloy. The plate members may be formed of glass, ceramics, or synthetic resin.

The nozzle plate 43 as the lowermost layer of the cavity unit 10 is an elongate plate member formed of synthetic resin. The nozzle plate 43 is formed with a multiplicity of ink ejection nozzles 54 each having an extremely small diameter. The nozzles 54 are formed through the thickness of the nozzle plate 43, in two straight rows extending in a first direction (i.e., in a longitudinal direction) of the nozzle plate 43, such that the nozzles 54 of each row are equally spaced apart from each other at a relatively small spacing pitch "P" (FIG. 4) and such that each of the nozzles 54 of one of the two rows is interposed between the adjacent two nozzles 54 of the other row in the longitudinal direction of the nozzle plate 43. Thus, the nozzles 54 are formed in the two rows, in a zigzag or staggered manner.

The manifold plate 12 has a pair of elongate manifold openings 12*a*, 12*a*, each as part of an ink channel. The two manifold openings 12*a* are formed through the thickness of the manifold plate 12 such that the two manifold openings 12*a* extend on opposite sides of the two straight rows of the nozzles 54, respectively. Each of the manifold openings 12*a* is aligned, in its plan view, with a corresponding one of two rows of the liquid chambers 16 formed in the cavity plate 14 described below, such that the each manifold opening 12*a* extends over the corresponding row of the liquid chambers 16 in a longitudinal direction of the cavity unit 10. The manifold plate 11 provided beneath the manifold plate 12 has, in its upper surface, a pair of manifold recesses 11, 11 that are open upward, are aligned with the two manifold openings 12*a*, 12*a*, respectively, and have substantially the same shape in their plan view as that of the manifold openings 12*a*. Each of the two manifold openings 12*a*, 12*a* cooperate with a corresponding one of the two manifold recesses 11*a*, 11*a* to define a manifold chamber.

The cavity plate 14 located above the manifold plate 12 with the spacer plate 13 being interposed therebetween is an elongate plate member functioning as the uppermost layer of the cavity unit 10. The cavity plate 14 has the two rows of the liquid chambers 16 formed through the thickness thereof such that the two rows of the liquid chambers 16 extend along a centerline of the cavity plate 14 that is parallel to a first direction (i.e., a longitudinal direction) of the cavity plate 14. In a state in which the plates 11, 12, 13, 14 are stacked on each other, the upper portion of each liquid chamber 16 which is remote from the spacer plate 13 is in an open state.

The two rows of the liquid chambers 16 are located on the respective opposite sides of the centerline of the cavity plate 14. Each of the liquid chambers 16 of one of the two rows is interposed between adjacent liquid chambers 16 of the other row in the direction of extension of the rows. Each liquid chamber 16 has an elongate shape that extends in a second direction (i.e., a transverse direction) of the cavity plate 14 that is perpendicular to the above-indicated center-line thereof.

Respective inner ends 16*a* of the liquid chambers 16 communicate with the corresponding nozzles 54 of the nozzle plate 43 via respective small-diameter through-holes 17 that are formed in two rows in a zigzag manner through the thickness of each of the space plate 13 and the two manifold plates 11, 12. On the other hand, respective outer ends 16*b* of the liquid chambers 16 of one of the two rows communicate with a corresponding one of the two manifold chambers of the manifold plates 11, 12 via a corresponding one of two rows of through-holes 18 that are formed through the thickness of the spacer plate 13 such that the rows of the through-holes 18 are respectively located near opposite long side edges of the spacer plate 13; and respective outer end portions of the liquid chambers 16 of the other row communicate with the other manifold chamber via the other row of through-holes 18 of the spacer plate 13. As shown in an enlarged view which is encircled in FIG. 4, the respective outer ends 16*b* of the liquid chambers 16 of the two rows are formed in a lower surface of the cavity plate 14 such that the outer ends 16*b* are open only downward.

In the cavity unit 10, there are formed supply holes 19. Described in detail, the cavity plate 14 has, at one of its longitudinally opposite end portions, two supply holes 19*a*, 19*a* that are formed through the thickness thereof and communicate with the two manifold openings 12*a* of the manifold plate 12, respectively; and the spacer plate 13 has, at one of its longitudinally opposite end portions, two supply holes 19*b*, 19*b* that are formed through the thickness thereof and communicate with the two manifold openings 12*a* of the manifold plate 12. The supply holes 19*a*, 19*a* of the cavity plate 14 and the supply holes 19*b*, 19*b* of the spacer plate 13 are aligned with each other in the direction of stacking of the plates.

In the cavity unit 10 constructed as described above, the ink supplied from the ink cartridges 61 to the two manifold chambers 11*a*, 12*a*; 11*a*, 12*a* via the supply holes 19*a*, 19*b* is distributed to the liquid chambers 16 via the respective through-holes 18, then reach, via the through-holes 17, the nozzles 54 corresponding to the liquid chambers 16, and is ejected therefrom.

Figure 3:
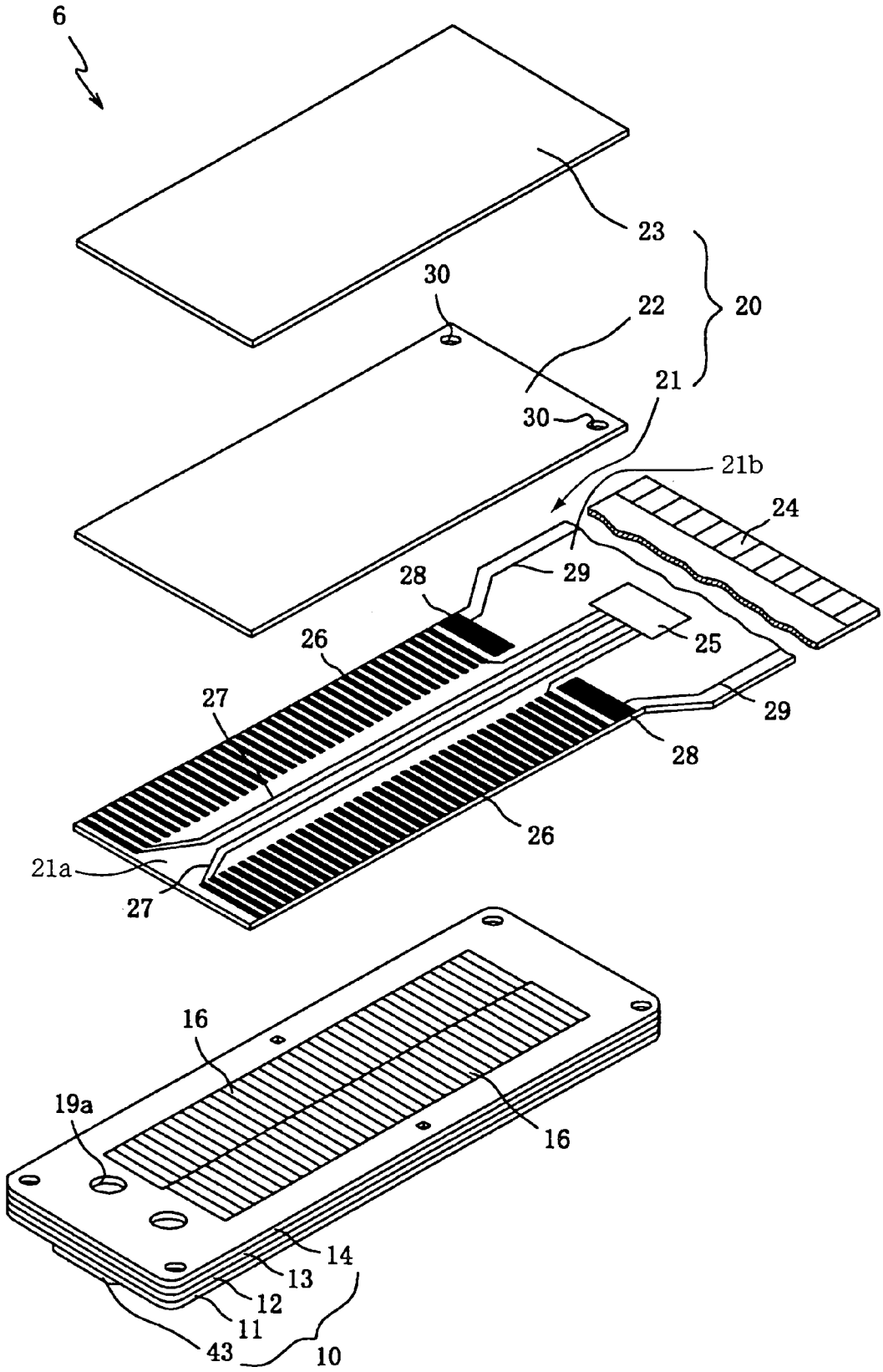
FIG. 3 is an exploded perspective view of the ink jet recording head of FIG. 2.

The piezoelectric actuator 20 stacked on the cavity unit 10 is deformed with respect to the liquid chambers 16, so that the volume of the liquid chambers 16 is changed. As shown in FIG. 3, the piezoelectric actuator 20 of the present embodiment includes an electrically insulating sheet 21, individual electrodes 26 formed on the insulating sheet 21, a piezoelectric element 22, an electrically conductive sheet 23 that are arranged in this order as seen in a direction of stacking away from the cavity unit 10.

Figure 4:
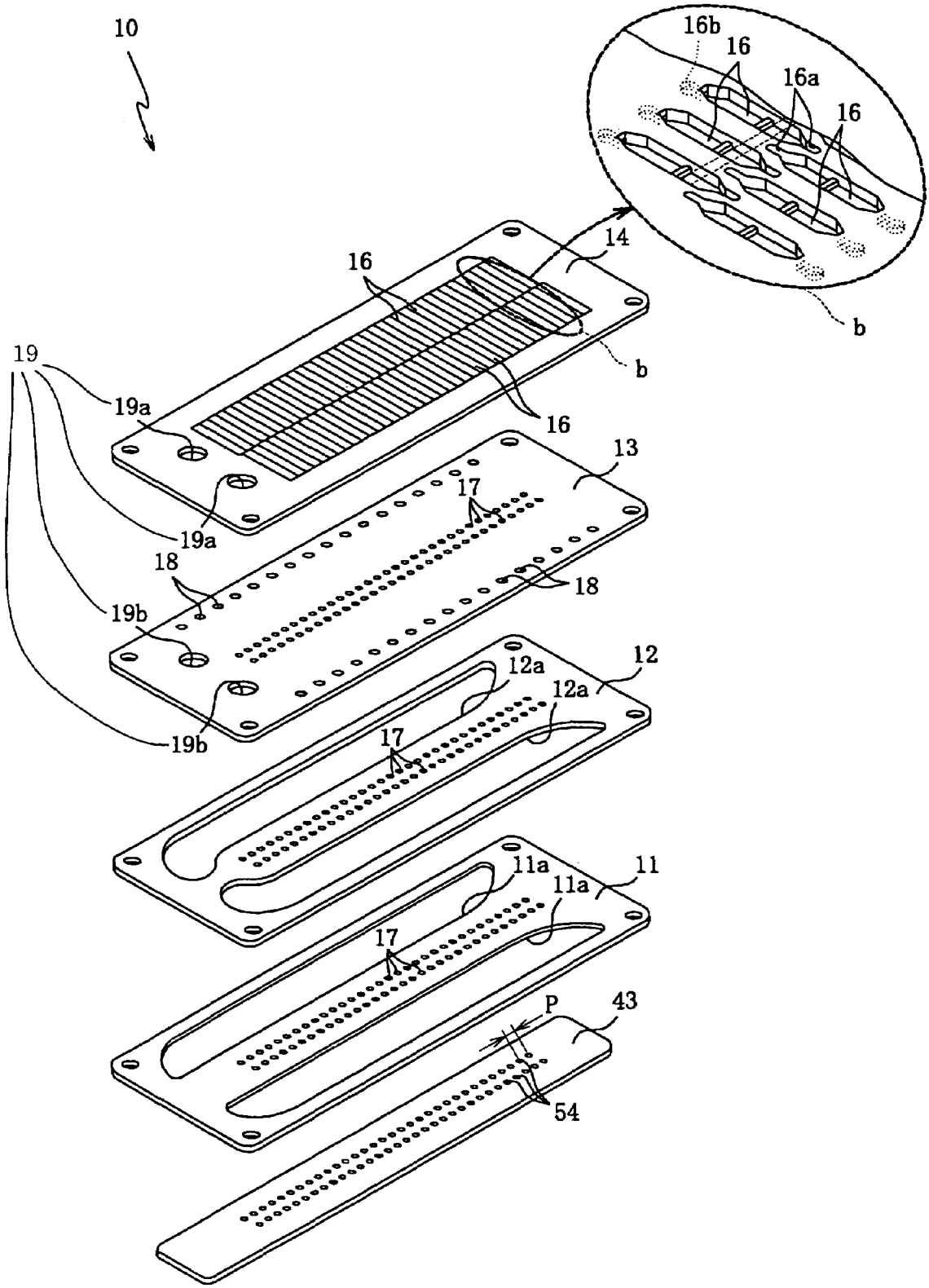
FIG. 4 is an exploded perspective view of a cavity unit of the ink jet recording head of FIG. 2.

The insulating sheet 21 functions as an oscillating plate which is oscillated or deformed by the piezoelectric element 22 and is formed of synthetic resin which has insulating characteristics and flexibility and contains, as a major component, polyimide. The insulating sheet 21 has a thickness of about 50 μm. The insulating sheet 21 is an elongate member which extends in a longitudinal direction of the cavity unit 10 and whose length is longer than that of the cavity unit 10. In other words, the insulating sheet 21 has a first portion 21*a* and a second or extended portion 21*b* which continuously extends from the first portion 21*a* outwardly of the cavity unit 10 in the longitudinal direction thereof, as shown in FIGS. 3 and 4. The insulating sheet 21 is fixed to the cavity plate 14 by an adhesive at its first portion 21*a* which extends over the plurality of liquid chambers 16 and covers the same 16. The second or extended portion 21*b* of the insulating sheet 21 is provided, at one of its longitudinally opposite ends that is remote from the first portion 21*a*, with a plurality of terminal portions 24 to be connected to an interface board 50 provided on the carriage 64. The interface board 50 is a relay board that transmits data signals supplied from the control circuits of the ink jet recording apparatus 100 to the drive circuit 25 mounted on the insulating sheet 21.

The drive circuit 25 mounted on the insulating sheet 21 converts serial data signals transmitted from the control circuits via the interface board 50, to parallel signals corresponding to the number of the nozzles 54, and generates a drive voltage to drive the piezoelectric element 22.

On one of opposite surfaces of the first portion 21*a* of the insulating sheet 21 that is remote from the cavity unit 10, there are provided a plurality of individual electrodes 26 which are aligned with the respective liquid chambers 16 formed in the cavity unit 10, a plurality of wires 27 for the respective individual electrodes 26 (hereinafter simply referred to as "individual-electrode wires 27") which connect the individual electrodes 26 to the drive circuit 25, and a pair of ground electrodes 28 which connect the conductive sheet 23 (described below) to the ground. On the second portion 21*b* of the insulating sheet 21, there are provided the drive circuit 25 and wires 29 for the ground electrodes 28 (hereinafter simply referred to as "ground-electrode wires 29") which connect the ground electrodes 28 to the ground. The individual-electrode wires 27 formed on the first portion 21*a* of the insulating sheet continuously extend on the second portion 21*b* thereof, so that the individual electrodes 26 and the drive circuit 25 are connected by the respective individual-electrode wires 27. In FIG. 3, only some of the plurality of the individual-electrode wires 27 are shown.

The individual electrodes 26 are formed on the first portion 21*a* of the insulating sheet 21 in two rows such that the two rows extend in a first direction (i.e., a longitudinal direction) of the insulating sheet 21, along the respective opposite long side edges of the first portion 21*a*. Each individual electrode 26 is in the form of an elongate strip extending in a second direction of the insulating sheet 21 perpendicular to the above-indicated first direction and has a width that is slightly smaller than that of each liquid chamber 16, in their plan view. The individual electrodes 26 are connected to the drive circuit 25 via the respective individual-electrode wires 27. The drive voltage outputted from output terminals of respective drivers of the drive circuit 25 is supplied to the individual electrodes 26 via the respective wires 27. In the present embodiment, the wires 27 extend between the two rows of the individual electrodes 26 in the above-indicated first direction.

In the present arrangement wherein the individual electrodes 26 and the individual-electrode wires 27 are formed on the same plane of the single insulating sheet 21, the electrical connection between the individual electrodes 26 and the individual-electrode wires 27 can be more simplified than in the conventional arrangement wherein the individual electrodes and the wires for the individual electrodes are formed on the respective different sheet members and the sheet members are superposed on each other such that the individual electrodes and the wires are connected to each other.

The piezoelectric element 22 is for deforming the insulating sheet 21 and is provided in a sheet form on the first portion 21*a* of the insulating sheet 21, so that the piezoelectric element 22 extends at least over all of the plurality of liquid chambers 16. In the present embodiment, the piezoelectric element 22 is common to all of the plurality of liquid chambers 16. The piezoelectric element 22 may be provided individually for the respective liquid chambers 16.

The piezoelectric element 22 is formed by using, as a major component, lead zirconium titanate which is solid solution of lead titanate and lead zirconate and which is ferroelectric. If the thickness of the piezoelectric element 22 is decreased, the drive voltage applied thereto can be lowered. In this case, however, the amount of deformation of the piezoelectric element 22 is reduced, and accordingly the amount of deformation of the insulating sheet 21 is reduced. Accordingly, where the thickness of the piezoelectric element 22 is decreased, the rigidity of the insulating sheet 21, in other words, the thickness thereof needs to be decreased.

In the present embodiment, the thickness of the insulating sheet 21 is considerably small, i.e., in a range of about 30 μm to about 50 μm while the thickness of the piezoelectric element 22 is about several microns (μm), e.g., about 10 μm. As a method of forming the piezoelectric element 22 whose thickness is in a range from about several microns (μm) to about 10 μm, there is employed an aerosol deposition method in which a fine particle material that provides the piezoelectric element 22 is collided at a high speed onto the insulating sheet 21, so that the particle material is deposited thereon to provide the piezoelectric element 22. As the fine particle material, any piezoelectric material such as lead zirconium titanate (PZT) may be used. The fine particle material for providing the piezoelectric element 22 has an average particle size of not greater than 1 μm. As another method of forming the piezoelectric element 22 having the thickness described above, a sol-gel method may be employed.

The conductive sheet 23 functions as a common electrode which is opposed to or corresponds to the individual electrodes 26, and is fixed to one of opposite surfaces of the piezoelectric element 22 that is remote from the insulating sheet 21, such that the conductive sheet 23 extends over the plurality of liquid chambers 16.

The conductive sheet 23 is formed of gold (Au) and has a thickness of about 1 μm. The conductive sheet 23 is electrically connected to the ground electrodes 28 formed on the insulating sheet 21, through a conductive material filled in through-holes 30 formed through the thickness of the piezoelectric element 22. Thus, the conductive sheet 23 is connected to the ground via the ground electrodes 28 and the ground-electrode wires 29. The individual electrodes 26 and the conductive sheet 23 are formed on the insulating sheet 21 and the piezoelectric element 22, respectively, by the aerodeposition method wherein a suitable fine particle material such as gold (Au) which has conductivity and whose average particle size is not greater than 1 μm is collided at a high speed and deposited onto the insulating sheet 21 and the piezoelectric element 22, respectively. Alternatively, the individual electrodes 26 and the conductive sheet 23 may be formed by printing or vapor deposition, as well known in the art. The individual electrodes 26 and the conductive sheet 23 may be formed by using respective different materials according to respective different methods.

The piezoelectric element 22 which is ferroelectric is polarized in one specific direction by application of a high voltage thereto and is kept in a polarized state after the application of the voltage is stopped. In the present embodiment, by applying, in advance, a voltage which is higher than a normal or usual drive voltage between the individual electrodes 26 and the conductive sheet 23, the piezoelectric element 22 is polarized in a direction from the individual electrodes 26 toward the conductive sheet 23, as indicated by an arrow "P" in FIGS. 5A and 5B. Described in detail, respective portions in the piezoelectric element 22 which are interposed between the individual electrodes 26 and the conductive sheet 23 are polarized, thereby providing active portions that undergo a strain when an electric voltage for a usual ink ejection operation is applied thereto. Where the piezoelectric element 22 is formed over the region corresponding at least to all liquid chambers 16 and is common to all chambers 16 as in the present embodiment, the piezoelectric element 22 includes a plurality of active portions. Where the piezoelectric element 22 is formed for each of the liquid chambers 16, the piezoelectric element 22*b* constitutes the active portion. Respective portions of the insulating sheet 21 as the oscillating plate which correspond to the respective active portions function as oscillating portions which are oscillated by deformation of the active portions.

Figure 5A:
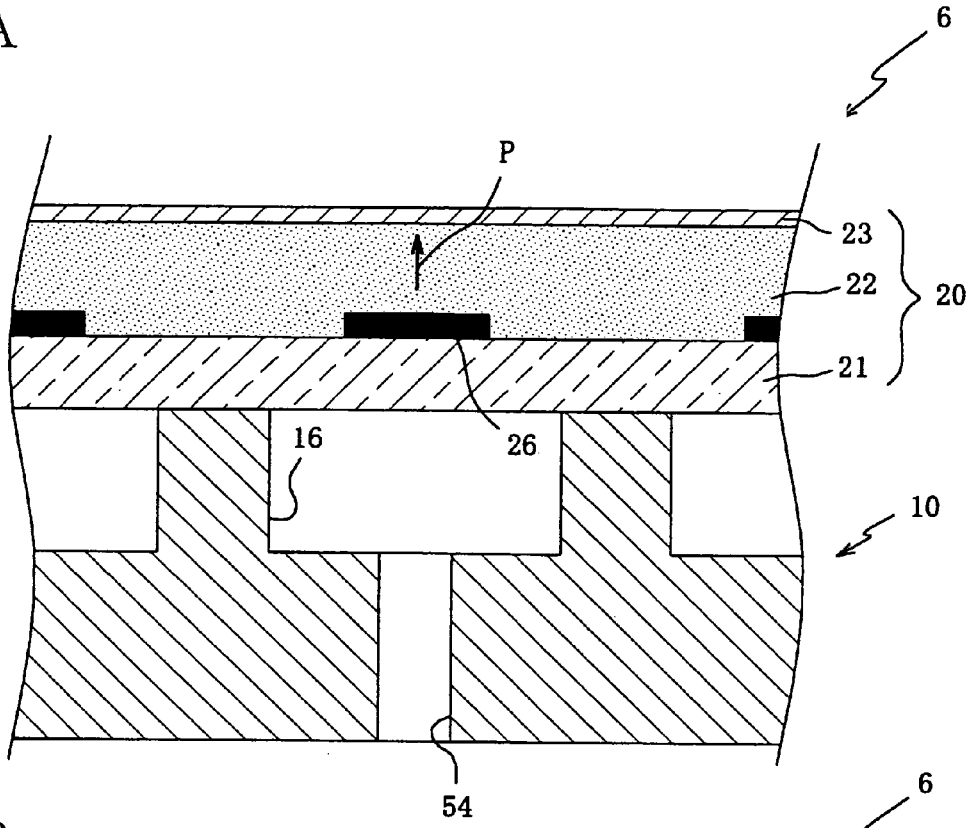
Figure 5B:
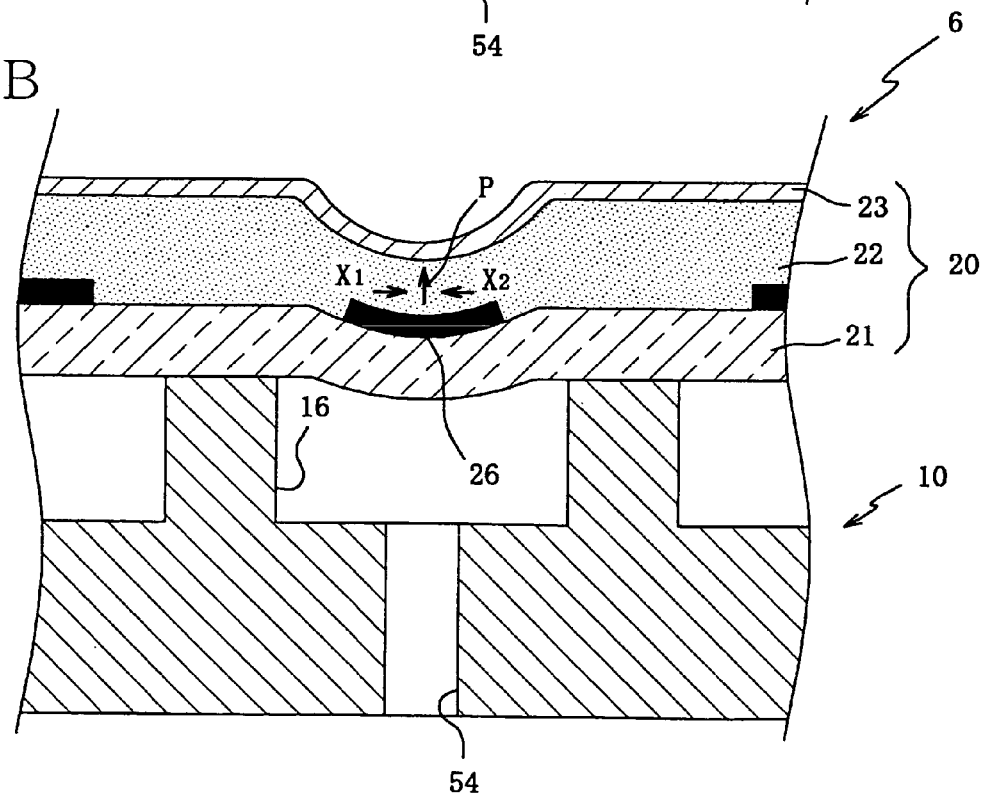

Referring next to FIG. 5B which corresponds to FIG. 5A and which shows a state in which the drive voltage is applied to an arbitrary individual electrode 26, there will be explained an ink ejecting operation conducted by the piezoelectric-type ink jet recording head 6 constructed as described above.

In the present embodiment, when the drive voltage is applied to the arbitrary individual electrode 26 from the drive circuit 25 mounted on the insulating sheet 21, via the corresponding individual-electrode wire 27, an electric field is produced in a direction from the individual electrode 26 toward the conductive sheet 23 connected to the ground, i.e., in the same direction as the polarization direction "P", so that a portion of the piezoelectric element 22 (active portion) located right above the individual electrode 26 to which the drive voltage is applied contracts in a direction perpendicular to the polarization direction "P" (namely, in opposite two directions indicated by arrows "X1" and "X2" in FIG. 5B). In this case, since the insulating sheet 21 does not contract, the active portion of the piezoelectric element 22 and the corresponding oscillating portion of the oscillating plate (insulating sheet 21) are curved or deformed such that the active portion and the oscillating portion protrude toward the corresponding liquid chamber 16.

As a result, the volume of the liquid chamber 16 corresponding to the arbitrary individual electrode 26 to which the drive voltage has been applied is decreased and the ink in that liquid chamber 16 is pressurized, so that the ink is ejected from the liquid chamber 16 via the corresponding nozzle 54.

Figure 6:
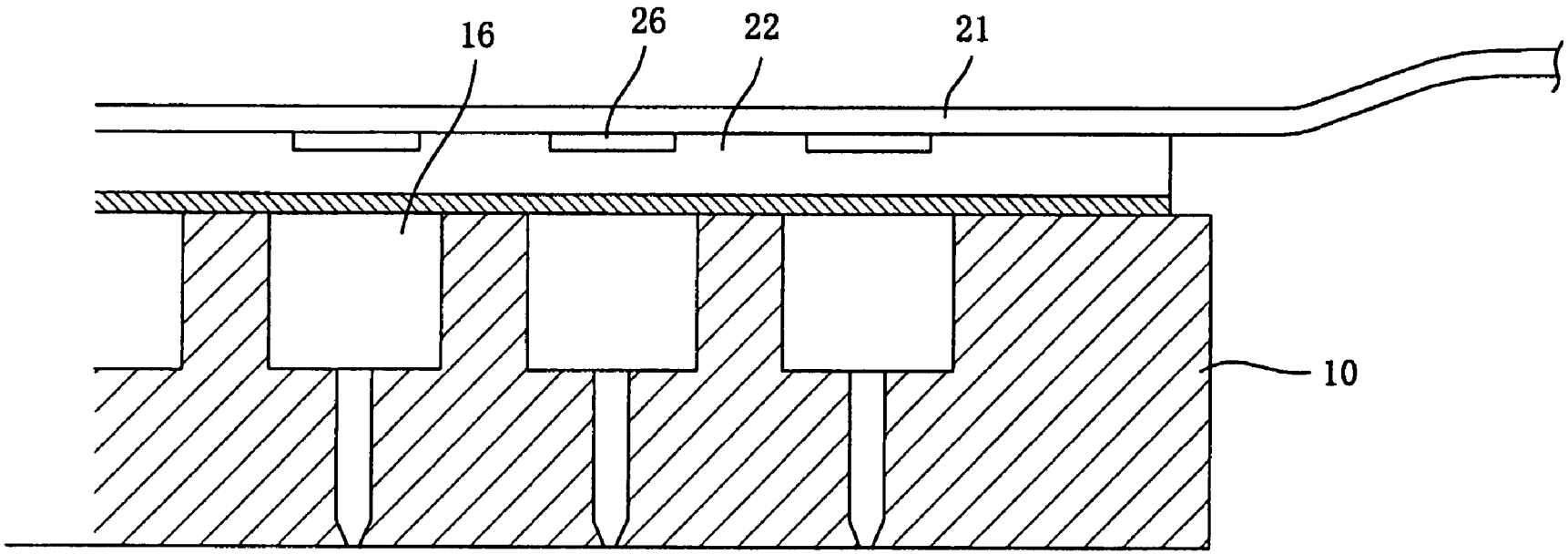
FIG. 6 is a cross sectional view schematically showing a piezoelectric-type ink jet recording head constructed according to another embodiment of the invention.

Referring next to FIG. 6, there will be described a second embodiment of the present invention. In this second embodiment, the same reference numerals as used in the illustrated first embodiment are used to identify the corresponding components, and a detailed explanation of which is not provided. In this second embodiment of FIG. 6, the actuator unit 20 is fixed to the cavity unit 10 in a vertically inverted state, as compared with the state shown in the first embodiment. Described in detail, the structure of the actuator unit 20 is identical with that in the first embodiment. Namely, the piezoelectric element 22 is formed on the surface of the insulating sheet 21 on which the electrodes 26, 28 and the wires 27, 29 are formed, and the conductive sheet 23 functioning as the common electrode is superposed on the piezoelectric element 22. In this second embodiment, however, the actuator unit 20 is fixed to the cavity unit 10 such that the conductive sheet 23 is located adjacent to the liquid chambers 16 and the insulating sheet 21 is located remote from the liquid chambers 16. In this case, the conductive sheet 23 is preferably formed of a material which is not rusted or corroded by the liquid in the liquid chambers 16. Alternatively, a layer of synthetic resin, for instance, may be interposed between the conductive sheet 23 and the cavity plate 14 in which the liquid chambers 16 are formed, for preventing the conductive sheet 23 from being rusted or corroded by the liquid.

In the embodiment of FIG. 6, when an electric field is produced in a direction from the individual electrode 26 toward the conductive sheet 23 parallel to the polarization direction, the piezoelectric element 22 contracts in a surface direction thereof. In this case, since the insulating sheet 21 does not contract, the piezoelectric actuator 20 is curved or deformed into an upwardly convex shape, namely in a direction to expand the liquid chamber 16. When the generation of the electric field is stopped, the piezoelectric actuator 20 returns to its original state or position, whereby the ink in the liquid chamber 16 is ejected from the corresponding nozzle 54.

In the ink jet recording head 6 constructed according to the illustrated first and second embodiments described above, the first portion 21*a* of the insulating sheet 21 on which the piezoelectric element 22 is superposed and the second portion 21*b* thereof on which the individual-electrode wires 27 are formed so as to continuously extend from the first portion 21*a* are given by the single, common insulating sheet 21. Therefore, the present arrangement is effective to reduce the number of required components, resulting in a reduction in the cost of manufacture of the ink jet recording head 6.

The individual electrodes 26 are formed on the insulating sheet 21 in alignment with the respective liquid chambers 16, so that the liquid chambers 16 can be driven or deformed individually in either of a case where the piezoelectric element 22 provided to correspond to all of the liquid chambers 16 is formed on the insulating sheet 21 in the sheet form as in the illustrated first and second embodiments and a case where the piezoelectric element 22 is formed individually on the insulating sheet 21 so as to correspond to the respective liquid chambers 16. Where the piezoelectric element 22 is formed on the insulating sheet 21 in the sheet form, the piezoelectric element 22 can be made common to all of the liquid chambers 16. In this case, the structure of the piezoelectric element 22 is more simplified and the cost of manufacture of the apparatus can be reduced, as compared with the case where the piezoelectric element 22 is provided individually for the respective liquid chambers 16.

In the illustrated first embodiment, the insulating sheet 21 is interposed between the liquid chambers 16 and the piezoelectric element 22 and functions as the oscillating plate which is oscillated by the deformation of the piezoelectric element 22. This arrangement is effective to reduce the number of required components and the cost of manufacture of the apparatus, as compared with an arrangement in which the oscillating plate is provided separately from the insulating sheet on which the wires are formed.

The liquid delivering apparatuses according to the illustrated first and second embodiments wherein the drive circuit 25 from which the drive voltage is supplied to the individual electrodes 26 is mounted on the insulating sheet 21 do not require an exclusive installation space for installing the drive circuit 25, resulting in reduction in the required installation space of the drive circuit 25 and the size of the apparatus.

In the illustrated first and second embodiments, the conductive sheet 23 is formed on one of the opposite surfaces of the piezoelectric element 22 that is remote from the insulating sheet 21, such that the conductive sheet 23 extends over the plurality of liquid chambers 16 and the thus formed conductive sheet 23 functions as the common electrode which is common to the plurality of liquid chambers 16. This arrangement effectively simplifies the structure of the electrode which is opposed to or corresponds to the individual electrodes 26 and reduces the cost of manufacture of the apparatus, as compared with an arrangement wherein a plurality of electrodes are provided so as to respectively correspond to the individual electrodes 26 provided for the respective liquid chambers 16.

In the illustrated first embodiment wherein the insulating sheet 21 is located between the liquid chambers 16 and the piezoelectric element 22, the piezoelectric element 22, the electrodes 26, 28, the wires 27, 29, and the conductive sheet 23 are not held in contact with the liquid in the liquid chambers 16 owing to the insulating sheet 21 located as described above, thereby effectively preventing short circuit, corrosion, etc., which may caused by the liquid.

In the illustrated first embodiment wherein the insulating sheet 21 is fixed to the cavity plate 14, such that the insulating sheet 21 covers the openings which are formed through the thickness of the cavity plate 14 and which provide the respective liquid chambers 16, the pressure in an arbitrary liquid chamber 16 can be changed by deformation of a portion of the insulating sheet 21 located above the corresponding liquid chamber 16. Further, since the cavity plate 14 is formed of the sheet-like member, the apparatus can be made compact or thin.

The piezoelectric element 22 in the illustrated first and second embodiments is formed on the insulating sheet 21 by depositing the fine particle material that provides the piezoelectric element 22. This arrangement permits the piezoelectric element 22 having the intended thickness to be formed on the relatively thin insulating sheet 21 and thereby assures a relatively large amount of deformation of the piezoelectric element 22 even where the piezoelectric element 22 is driven by a relatively low drive voltage, resulting in reduction of the running cost of the apparatus.

In the illustrated first and second embodiments, the individual electrodes 26 and the ground electrodes 28 are formed by depositing, on the insulating sheet 21, the fine particle material such as gold (Au) which has conductivity and whose average particle size is not greater than 1 μm while the conductive sheet 23 is formed by depositing, on the piezoelectric element 22, the fine particle material which has conductivity. In these arrangements, the electrodes 26, 28, and the conductive sheet 23 are formed with the respective suitable thickness values, so that the piezoelectric element 22 can be deformed with high efficiency. The individual electrode 26 and the ground electrodes 28 may be formed by using respective different materials according to respective different methods.

While the preferred embodiments of the present invention have been described above, for illustrative purpose only, it is to be understood that the invention is not limited to the details of the illustrated embodiments, but may be embodied with various changes and modifications, which may occur to those skilled in the art, without departing from the spirit and scope of the invention defined in the attached claims.

In the illustrated first and second embodiments, the conductive sheet 23 is electrically connected to the ground electrodes 28 formed on the insulating sheet 21, via the conductive material in the through-holes 30 formed in the piezoelectric element 22, so that the conductive sheet 23 is connected to the ground. The manner in which the conductive sheet 23 is connected to the ground is not limited to that in the illustrated embodiments. For instance, the conductive material may be provided on side surfaces of the piezoelectric element 22 which are perpendicular to the opposite major surfaces thereof. In this case, the conductive sheet 23 and the ground electrodes 28 are electrically connected to each other via the conductive material provided on the side surfaces of the piezoelectric element 22.

In the illustrated first and second embodiments, the conductive sheet 23 functions as the common electrode which is opposed to or corresponds to the individual electrodes 26. The common electrode may be provided otherwise. For instance, the conductive sheet 23 may be replaced with an insulating sheet formed of synthetic resin, and a common electrode may be formed on one of opposite major surfaces of the insulating sheet which is opposed to the piezoelectric element. 22. In this case, the piezoelectric ink jet recording head 6 can be produced at a reduced cost by using the insulating sheet formed of synthetic resin which is less expensive than the conductive sheet 23.

While the liquid delivering apparatus in the form of the ink jet recording head 6 has been described above as the preferred embodiments of the present invention, the principle of the invention is equally applicable to various types of apparatus, provided that the apparatus is arranged to deliver liquid by applying pressure to the liquid owing to deformation of the piezoelectric element.

What is claimed is:

1. A liquid delivering apparatus including:

at least one piezoelectric element;

a plurality of liquid chambers which store liquid, the liquid being given pressure by deformation of said at least one piezoelectric element, so that the liquid is delivered from the plurality of liquid chambers to an exterior of the apparatus;

a plurality of electrodes which generate an electric field for deforming said at least one piezoelectric element and which include a plurality of individual electrodes respectively overlapping the plurality of liquid chambers;

a drive circuit which supplies a drive voltage to the plurality of electrodes; and an insulating sheet and a plurality of wires which respectively connect the plurality of electrodes to the drive circuit, the plurality of electrodes and the plurality of wires being formed on the insulating sheet without said at least one piezoelectric element interposed between the insulating sheet and the plurality of electrodes.

2. The liquid delivering apparatus according to claim 1, wherein said at least one piezoelectric element is formed on the insulating sheet so as to be superposed on the plurality of electrodes, the insulating sheet including a first portion on which said at least one piezoelectric element and the plurality of wires are formed and a second portion which extends outwards from the first portion and on which the plurality of wires are formed so as to continuously extend from the first portion.

3. The liquid delivering apparatus according to claim 2, wherein the plurality of liquid chambers are arranged side by side on one plane and the insulating sheet extends over the plurality of liquid chambers, said at least one piezoelectric element being formed on the first portion of the insulating sheet so as to extend at least over each of the plurality of liquid chambers.

4. The liquid delivering apparatus according to claim 3, wherein said at least one piezoelectric element is provided in a sheet form on the first portion of the insulating sheet and extends over the plurality of liquid chambers.

5. The liquid delivering apparatus according to claim 2, wherein the plurality of electrodes are arranged on the first portion of the insulating sheet in at least one row extending in a longitudinal direction of the insulating sheet, and the plurality of wires are respectively connected to the plurality of electrodes and extend along said at least one row of the plurality of electrodes in the longitudinal direction.

6. The liquid delivering apparatus according to claim 2, wherein the plurality of electrodes are arranged on the first portion of the insulating sheet in at least two rows each extending in a longitudinal direction of the insulating sheet, and the plurality of wires are respectively connected to the plurality of electrodes and extend between said at least two rows of the plurality of electrodes in the longitudinal direction.

7. The liquid delivering apparatus according to claim 2, further including at least one terminal portion which is connected to an external interface board and which is provided at one of longitudinally opposite ends of the second portion of the insulating sheet that is remote from the first portion of the insulating sheet.

8. The liquid delivering apparatus according to claim 3, further including a conductive sheet which is formed on one of opposite sides of said at least one piezoelectric element that is remote from the insulating sheet so as to extend over the plurality of liquid chambers and which functions as an electrode that is opposed to the plurality of electrodes.

9. The liquid delivering apparatus according to claim 8, wherein the plurality of electrodes include at least one ground electrode and the plurality of wires include at least one ground-electrode wire which connects the at least one ground electrode to ground, said at least one ground electrode being electrically connected to the conductive sheet through a conductive material provided on said at least one piezoelectric element for connecting said at least one ground electrode to the conductive sheet.

10. The liquid delivering apparatus according to claim 9, wherein said at least one ground electrode is electrically connected to the conductive sheet through the conductive material filled in through-holes formed through the at least one piezoelectric element.

11. The liquid delivering apparatus according to claim 8, wherein the insulating sheet is interposed between the plurality of liquid chambers and said at least one piezoelectric element, and said at least one piezoelectric element is provided in a sheet form on the first portion of the insulating sheet so as to extend over the plurality of liquid chambers, the conductive sheet extending over the plurality of liquid chambers along one of opposite surfaces of said at least one piezoelectric element provided in the sheet form, that is remote from the insulating sheet.

12. The liquid delivering apparatus according to claim 8, further including a sheet-like cavity plate having a plurality of openings which respectively provide the plurality of liquid chambers, the insulating sheet being superposed on and fixed to the sheet-like cavity plate so as to close the plurality of openings.

13. The liquid delivering apparatus according to claim 8, wherein the conductive sheet is formed on said at least one piezoelectric element by depositing a fine particle material having conductivity.

14. The liquid delivering apparatus according to claim 1, wherein the insulating sheet is interposed between the plurality of liquid chambers and said at least one piezoelectric element and functions as an oscillating plate which is oscillated by the deformation of said at least one piezoelectric element so as to pressurize the liquid in the plurality of liquid chambers.

15. The liquid delivering apparatus according to claim 14, wherein portions of said at least one piezoelectric element which are interposed between the plurality of individual electrodes and a conductive sheet formed on one of opposite sides of said at least one piezoelectric element that is remote from the insulating sheet being polarized so as to give active portions which are deformed with respect to the plurality of liquid chambers, the oscillating plate having oscillating portions which are oscillated by deformation of the active portions.

16. The liquid delivering apparatus according to claim 1, wherein the drive circuit is mounted on the insulating sheet.

17. The liquid delivering apparatus according to claim 1, wherein said at least one piezoelectric element is formed on the insulating sheet by depositing a fine particle material that provides said at least one piezoelectric element.

18. The liquid delivering apparatus according to claim 1, wherein the plurality of electrodes are formed on at least one of the insulating sheet and said at least one piezoelectric element by depositing a fine particle material having conductivity.

19. The liquid delivering apparatus according to claim 1, wherein the plurality of electrodes include at least one ground electrode and the plurality of wires include at least one ground-electrode wire which connects said at least one ground electrode to the ground, said at least one ground electrode and said at least one ground-electrode wire being formed on the insulating sheet.

20. The liquid delivering apparatus according to claim 19, wherein said at least one ground electrode is formed at one of longitudinally opposite ends of the first portion of the insulating sheet that is nearer to the second portion and said at least one ground-electrode wire is formed to extend on the second portion of the insulating sheet.

21. The liquid delivering apparatus according to claim 1, wherein the liquid stored in the plurality of liquid chambers is ink and the liquid delivering apparatus further includes a plurality of nozzles which respectively communicate with the plurality of liquid chambers and from which the ink is ejected to the exterior of the apparatus, the liquid delivering apparatus constituting an ink jet recording head.

22. An ink-jet recording apparatus including:

the liquid delivering apparatus defined in claim 21;

a recording medium supporting member which supports a recording medium toward which the liquid delivering apparatus delivers the liquid;

a supporting member by which the liquid delivering apparatus is supported; and moving device which relatively moves the recording medium and the liquid delivering apparatus supported by the supporting member, to each other.

* * * * *